US009038235B2

(12) United States Patent
Van Der Kooi et al.

(10) Patent No.: US 9,038,235 B2
(45) Date of Patent: May 26, 2015

(54) VACUUM CLEANER

(75) Inventors: Johannes Tseard Van Der Kooi, Drachten (NL); Fokke Roelof Voorhorst, Drachten (NL); Bastiaan Johannes De Wit, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 267 days.

(21) Appl. No.: 13/508,848

(22) PCT Filed: Sep. 21, 2010

(86) PCT No.: PCT/IB2010/054260
§ 371 (c)(1),
(2), (4) Date: May 9, 2012

(87) PCT Pub. No.: WO2011/070452
PCT Pub. Date: Jun. 16, 2011

(65) Prior Publication Data

US 2012/0233807 A1 Sep. 20, 2012

(30) Foreign Application Priority Data

Dec. 10, 2009 (EP) ..... 09178626

(51) Int. Cl.

| | |
|---|---|
| ***A47L 9/10*** | (2006.01) |
| ***A47L 5/22*** | (2006.01) |
| ***A47L 9/00*** | (2006.01) |
| ***A47L 5/36*** | (2006.01) |
| ***A47L 9/19*** | (2006.01) |

(52) U.S. Cl.
CPC ..... *A47L 9/0072* (2013.01); *A47L 5/365* (2013.01); *A47L 9/19* (2013.01)

(58) Field of Classification Search
USPC ..... 15/347, 352, 353
IPC ..... A47L 9/10,5/22
See application file for complete search history.

(56) References Cited

U.S. PATENT DOCUMENTS

| | | | | |
|---|---|---|---|---|
| 4,348,447 | A | 9/1982 | Miller, Jr. | |
| 4,623,366 | A | 11/1986 | Berfield et al. | |
| 5,062,870 | A | 11/1991 | Dyson | |
| 2005/0166350 | A1 | 8/2005 | Buckner | |
| 2008/0230446 | A1* | 9/2008 | Bertram et al. | 209/10 |
| 2008/0263815 | A1* | 10/2008 | Oh et al. | 15/347 |
| 2012/0233807 | A1 | 9/2012 | Van Der Kooi | |

FOREIGN PATENT DOCUMENTS

| | | | |
|---|---|---|---|
| GB | 1400106 | A | 7/1975 |
| JP | 57183816 | A | 11/1982 |
| WO | 0203844 | A1 | 1/2002 |

OTHER PUBLICATIONS

"Cracking the Brazil Nut Effect", Technical Paper, http://www.csef.colostate.edu/2006_Technical_Paper_Winner.pdf.

* cited by examiner

*Primary Examiner* — Dung Van Nguyen

(57) ABSTRACT

A vacuum cleaner (1, 21, 41, 51) for dry dust comprises at least a dust chamber (3, 23, 43, 53) and a fan unit(13, 63), which dust chamber (3, 23, 43, 53) is provided with an air inlet opening (7, 27, 57) and an air outlet opening (8, 28) communicating with the fan unit (13, 63). The dust chamber (3, 23, 43, 53) comprises a movable body (9, 29, 59) for restricting air flow through the dust chamber (3, 23, 43, 53). In use the movable body (9, 29, 59) is located on dry dust collected in the dust chamber (3, 23, 43, 53) due to kinematic sorting between the movable body (9, 29, 59) and the dry dust.

14 Claims, 3 Drawing Sheets

VACUUM CLEANER

FIELD OF THE INVENTION

The invention relates to a vacuum cleaner for dry dust comprising at least a dust chamber and a fan unit, which dust chamber is provided with an air inlet opening and an air outlet opening communicating with the fan unit.

BACKGROUND OF THE INVENTION

Such a vacuum cleaner, which is known from U.S. Pat. No. 5,062,870 is being used for removing dust from a surface. By means of the motor driven fan unit a flow of air will be created through the vacuum cleaner. The known vacuum cleaner is provided with a movable valve for closing off the air inlet opening at a certain differential pressure between the air inlet opening and the dust chamber. By closing off the air inlet opening dust laden air is being prevented from entering the vacuum cleaner when the dust chamber is full with dust.

In vacuum cleaners for removing dry dust it is also known to detect the current needed for driving the motor or the motor torque needed for rotating the fan unit. If the current of torque level reaches a certain predetermined level, this will be an indication that the dust chamber is full.

GB 1,400,106 discloses a suction cleaner, particularly for removing both solids and liquids from surfaces, comprises a motor-fan unit mounted on a receptacle into which it draws picked up material, e.g. via a nozzle and hose coupled to an inlet, and a filter diaphragm spaced from but extending across the admission inlet of the unit, and deflectable due to the pressure drop across it which occurs during operation of the cleaner due to partial clogging of the filter diaphragm, and/or by engagement by a member moved in response to the liquid level in the receptacle, to cause a sealing pad, supported between the filter and the inlet, to close the latter, thereby halting the pick-up of material. The filter is moved against the action of a coil spring to close the inlet by the pad, the movement of the filter being assisted, when liquid is collected, by a cranked arm acted upon by a float.

SUMMARY OF THE INVENTION

It is an object of the invention to provide a vacuum cleaner for dry dust with means for restricting, preferably closing off, the air outlet opening when the dust chamber is full.

This object is accomplished with the vacuum cleaner according to the invention in that the dust chamber comprises a movable body for restricting air flow through the dust chamber, wherein in use the movable body is located on dry dust collected in the dust chamber due to kinematic sorting between the movable body and the dry dust, kinematic sorting referring to the fact that the largest particles end up on the surface when a granular material containing a mixture of particles of different sizes is shaken.

The movable body is larger than relatively small particles of dry dust or dirt collected in the dust chamber. Due to the motor driven fan unit the dust chamber will be vibrated. By vibrating the dust chamber also the dry dust, dirt and the movable body will be vibrated, whereby the relatively large movable body will start "floating" on the relatively light and small dry dust particles, since the small dry dust particles will fill up the space below the movable body. The movable body will be moved upwards by the dry dust particles when the dust chamber gets filled with dry dust until the movable body reaches and closes the air inlet opening or the air outlet opening. While the movable body is moving, the flowthrough opening between the movable body and the air inlet opening or the air outlet opening is decreased and consequently the airflow through the dust chamber is restricted until the moment that no more air can flow through the dust chamber and the flow of air is being ultimately restricted, i.e. closed off. The phenomenon of kinematic sorting is also called the "Brazil nut effect" referring to the fact that the largest particles end up on the surface when a granular material containing a mixture of particles of different sizes is shaken.

An embodiment of the vacuum cleaner according to the invention is characterized in the movable body comprises a valve for closing off the air outlet opening.

Preferably, the air outlet opening is located at a higher position in the dust chamber than the air inlet opening. By closing off the air outlet opening, more dust can be collected in the dust chamber before the flow of air is being restricted by means of the movable body.

Another embodiment of the vacuum cleaner according to the invention is characterized in that the vacuum cleaner comprises means for vibrating the dust chamber or the movable body.

Due to vibration of the dust chamber or vibration of the movable body only by means of the vibrating means, the vibration between the movable body and the dry dust particles will be promoted and therefore the movable body will be positioned more easily on the dry dust particles.

Yet another embodiment of the vacuum cleaner according to the invention is characterized in that the movable body is pivotably connected to a wall of the dust chamber between the air inlet opening and the air outlet opening.

The dry dust laden air will enter the dust chamber via the air inlet opening. The air may be directed towards and against the pivotable movable body, thereby supporting the movable body by moving towards the air outlet opening.

Yet another embodiment of the vacuum cleaner according to the invention is characterized in that the movable body is guided by a linear guide.

With such a linear guide a controlled movement of the movable body is being obtained.

A further embodiment of the vacuum cleaner according to the invention is characterized in that the dust chamber is provided with a tapered shaped part near the air outlet opening.

The movable body or at least a part thereof will be guided by the tapered shaped part towards the air outlet opening.

Yet a further embodiment of the vacuum cleaner according to the invention is characterized in that the fan unit comprises a motor, a fan rotatable by means of the motor and a dust separator connected to the fan.

Very small particles of dry dust which pass the air outlet opening of the dust chamber will be separated from the air by the dust separator before the air is expelled to the atmosphere. The very small particles of dry dust will remain in the vacuum cleaner.

BRIEF DESCRIPTION OF THE DRAWINGS

The invention will be explained in more detail with reference to the drawing, in which.

DETAILED DESCRIPTION OF EMBODIMENTS

In the figures, like parts are indicated by the same numerals.

Figure 1A:
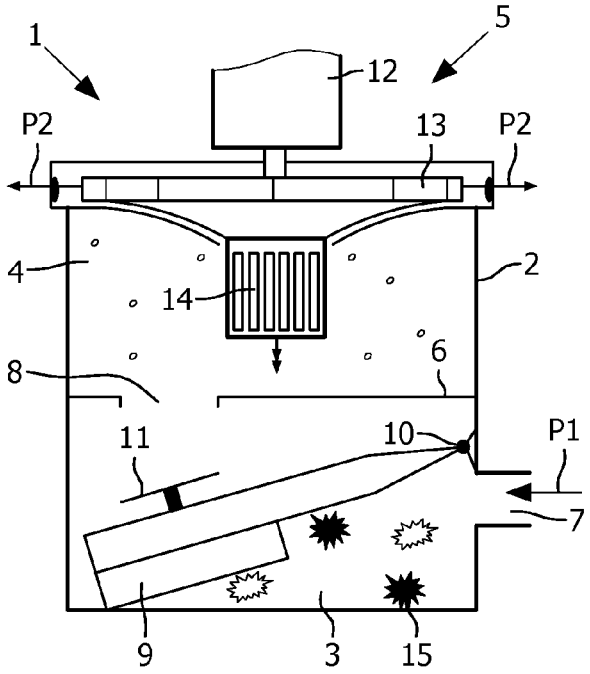
FIGS. 1A and 1B are schematic side views of a first embodiment of vacuum cleaner according to the invention, with an open and closed air outlet opening respectively.
Figure 1B:
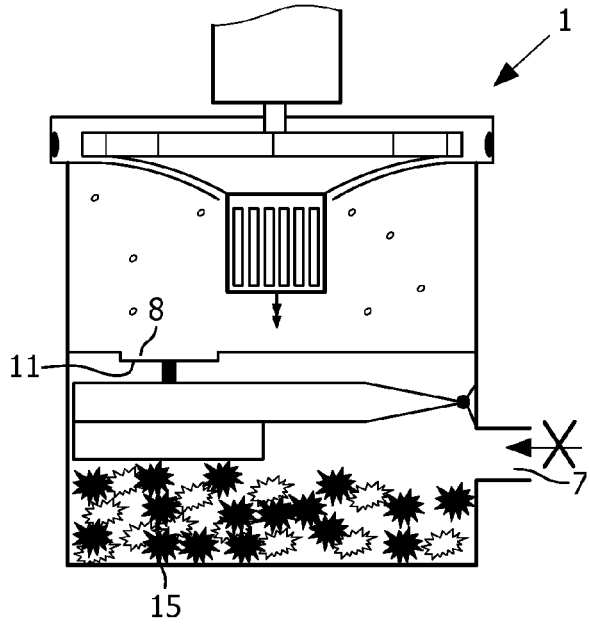

FIGS. 1A and 1B show a vacuum cleaner 1 according to the invention, which comprises a housing 2 being divided in a dust chamber 3 and a chamber 4 for a fan unit 5 by a wall 6. The dust chamber 3 comprises an air inlet opening 7 and an air outlet opening 8 located in the wall 6. A movable body 9 is located in the dust chamber 3 and is pivotably about a pivot axis 10. The pivot axis 10 is connected to the housing 2 between the air inlet opening 7 and the air outlet opening 8. The movable body 9 is provided with a valve 11 being positionable against the air outlet opening 8 to close off the air outlet opening 8.

The fan unit 5 is provided with a motor 12, a fan 13 being rotatable by means of the motor 12 and a dust separator 14 connected to the fan 13 and being rotatable together with the fan 13. The dust separator 14 might be a filter or a cyclone type separator.

The vacuum cleaner 1 according to the invention works as follows. A tube will be connected in a known manner to the air inlet opening 7. The tube can be provided at an end remote of the air inlet opening 7 with a nozzle in a known manner. The motor 12 will be driven due to which the fan 13 and the dust separator 14 will be rotated and a flow of air will be generated in a direction indicated by the arrows P1, P2 from the air inlet opening 7 via the air outlet opening 8 in the wall 6 towards and through the fan 13. Dry dust laden air will flow through the air inlet opening 7 into the dust chamber 3, where the dry dust will be gathered at the bottom of the dust chamber 3. Due to the vibrations of the motor 12, the small dry dust particles 15 will fill the space below the larger movable body 9 due to which the movable body 9 will start to move on top of the dry dust particles 15. The movable body 9 will pivot about the pivot axis 10 and the valve 11 will be moved towards the air outlet opening 8 until the amount of dry dust particles 15 below the movable body 9 is so large that the valve 11 is located against the wall 6 and the air outlet opening 8 is closed off by the valve 11 (see FIG. 1B). With the air outlet opening 8 being closed off, air can no longer be sucked into the air inlet opening 7. The user will notice this and become aware that the dust chamber 3 is full with dry dust and needs to be emptied.

Figure 2:
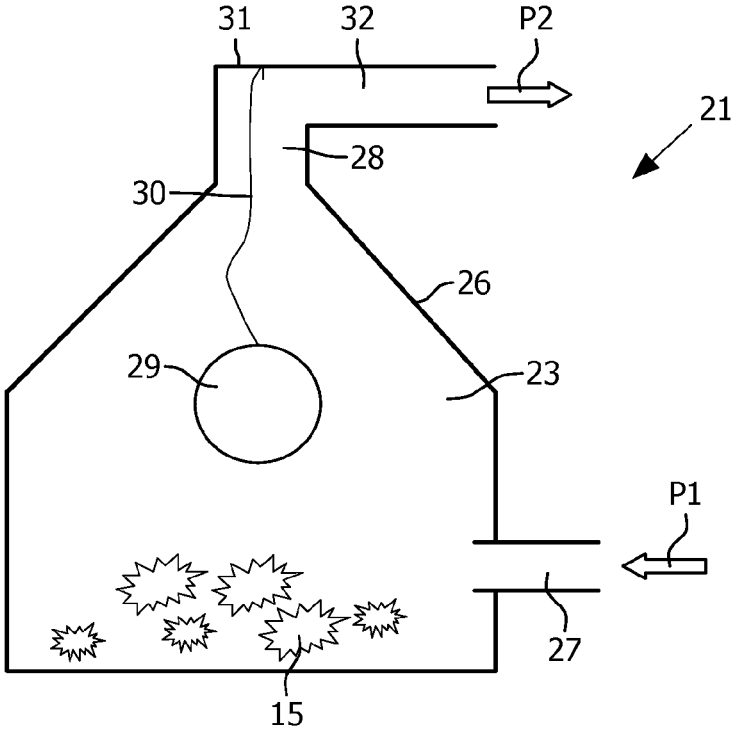
FIG. 2 is a schematic side view of a second embodiment of vacuum cleaner according to the invention.

FIG. 2 show a vacuum cleaner 21 according to the invention, which comprises a dust chamber 23. The dust chamber 23 comprises an air inlet opening 27 and an air outlet opening 28 located in a tapered shaped wall 26. A movable bal shaped valve 29 is located in the dust chamber 23 and is connected by means of a wire 30 to a wall 31 of the air outlet 32. A fan unit (not shown) is provided at an end of the air outlet remote of the air outlet opening 28 of the dust chamber 23.

When the dust chamber 23 is filled with small dust particles 15, the valve 29 will remain on top of the dust particles 15 due to the vibration of the valve 29 with respect to the dust particles 15. These vibrations might by realized by specific vibration means or are caused by vibrations of the motor of the fan unit. The ball shaped valve 29 will be guided by the tapered shaped wall 26 to the air outlet opening 28 until the valve 29 closes off the air outlet opening 28.

Figure 3:
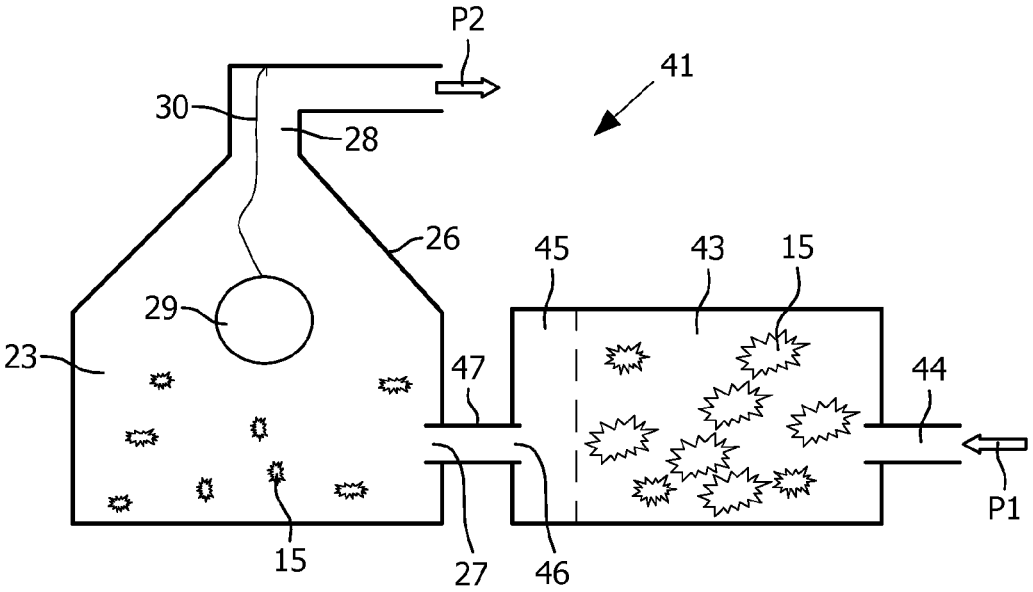
FIG. 3 is a schematic side view of a third embodiment of vacuum cleaner according to the invention.

FIG. 3 shows a vacuum cleaner 41 according to the invention, which comprises a dust chamber 23 also referred to as second dust chamber 23. Dust chamber 23 is similar to the dust chamber as shown in FIG. 2. The vacuum cleaner 41 further comprises a dust chamber 43 also referred to as first dust chamber 43. The dust chamber 43 is provided with an air inlet opening 44, a dust filter 45 for relatively large dust particles and an air outlet opening 46. The air outlet opening 46 is connected by means of a tube 47 to the air inlet opening 27 of the dust chamber 23. By the vacuum cleaner 41 large dust particle 15 will be collected in the first dust chamber 43 whilst smaller dust particles 15 will be collected in the second dust chamber 23. The first dust chamber 43 with its filter 45 acts as a pre-separator, whilst in the second dust chamber 23 a further separation step takes pace. In this way a separation device located in the second dust chamber 23 only needs to be suitable for separating relatively small particles from the air. The separation device may comprises a centrifugal fan or filter. The ball shaped valve 29 will stay on top of the dry dust particles 15 due to the kinematic sorting effect.

Figure 4A:
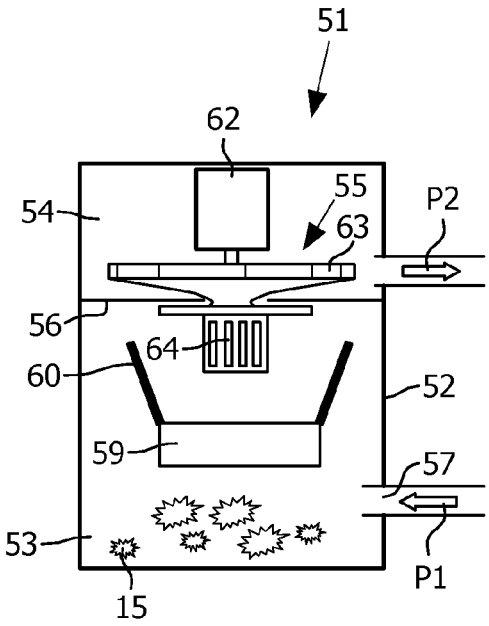
FIGS. 4A and 4B are schematic side views of a fourth embodiment of vacuum cleaner according to the invention, with an open and closed air outlet opening respectively.
Figure 4B:
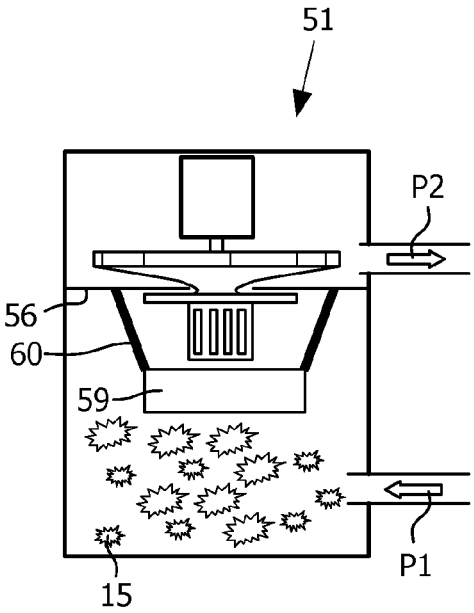

FIGS. 4A and 4B show a fourth embodiment of a vacuum cleaner 51 according to the invention, which comprises a housing 52 being divided in a dust chamber 53 and a chamber 54 for a fan unit 55 by a wall 56. The dust chamber 53 comprises an air inlet opening 57. A movable body 59 is located in the dust chamber 53 and is guided by a guide (not visible) in a direction perpendicular to the wall 56. The movable body 59 comprises a funnel shaped part 60 extending towards the wall 56.

The fan unit 55 is provided with a motor 62, a vacuum fan 63 being rotatable by means of the motor 62 and a centrifugal fan 64 connected to the vacuum fan 63 and being rotatable together with the fan 63. The centrifugal fan 64 is located inside the dust chamber 53. Air leaves the dust chamber 53 through the centrifugal fan 64, whereby remaining airborne dust particles will be removed from the air by centrifugal forces. In use the movable body 59 will be moved upwards by the dust particles 15 collected in the dust chamber 53 towards the wall 56. As soon as the funnel shaped part 60 of the movable body 59 will contact the wall 56, the flow of air toward the dust separator 64 is shut off.

While the invention has been illustrated and described in detail in the drawings and foregoing description, such illustration and description are to be considered illustrative or exemplary and not restrictive; the invention is not limited to the disclosed embodiments.

For example, it is possible to vibrate the movable body itself with respect to the dust chamber.

It is also possible to position the pivot axis 10 inside chamber 4 and provide the movable body 9 with an arm extending through opening 8.

The part 60 may have another kind of shape than funnel-shaped.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

As the skilled person will appreciate, the concept of a vacuum cleaner has to be construed as a device which is suitable for cleaning the floor by causing a transport of particles by and in a flow of air. The flow of air does not necessarily have to be caused by vacuum as in regular vacuum cleaners; it can also be provoked by for example one or more rotating brushes which contact the floor and which pump up the air containing the particles by propelling mechanisms other than the creation of a vacuum as in most state of the art "vacuum" cleaners. The concept of a vacuum cleaner implies that a pressure difference is present which causes a transport of dirt laden air.

The invention claimed is:

1. A vacuum cleaner for dry dust, said vacuum cleaner comprising:

a dust chamber having an air inlet opening and an air outlet opening;

a fan unit arranged for producing an air flow from the air inlet opening to the air outlet opening and carrying the dry dust for collection in the dust chamber;

a movable body supported in the dust chamber and arranged such that, in operation, said movable body rests on dry dust collected in the dust chamber due to kinematic sorting between the movable body and the dry dust and moves in a direction that increasingly restricts said air flow as the amount of dry dust in said dust chamber increases, kinematic sorting referring to a process whereby a mixture of larger and smaller objects is vibrated to effect sorting of said objects such that the larger objects become located above the smaller objects;

said vacuum cleaner being adapted to effect vibration of at least one of the movable body and the dry dust chamber to produce said kinematic sorting.

2. The vacuum cleaner according to claim 1 where the movable body comprises a valve for closing the air outlet opening.

3. The vacuum cleaner according to claim 2 where the dust chamber comprises a taper shaped part for guiding the valve to the air outlet opening.

4. The vacuum cleaner according to claim 1 where the vacuum cleaner is adapted to effect said vibration by vibrating the dust chamber relative to the movable body.

5. The vacuum cleaner according to claim 1 where the vacuum cleaner is adapted to effect said vibration by vibrating the movable body relative to the dust chamber.

6. The vacuum cleaner according to claim 1 where the movable body is pivotably connected to a wall of the dust chamber between the air inlet opening and the air outlet opening.

7. The vacuum cleaner according to claim 1 and including a linear guide for guiding the movable body.

8. The vacuum cleaner according to claim 1, said vacuum-cleaner comprising a pre-separator for separating relatively large dry dust particles from relatively small dry dust particles, said pre-separator being located between the air inlet opening and the dust chamber.

9. The vacuum cleaner according to claim 1 where the fan unit comprises a vacuum fan, a motor for rotating the vacuum fan, and a centrifugal fan connected for rotation with the vacuum fan said centrifugal fan being disposed for removing airborne dry dust not collected by the dust chamber.

10. The vacuum cleaner according to claim 9 where the movable body comprises a part for shutting off the air flow to the centrifugal fan.

11. The vacuum cleaner according to claim 10 where the part for shutting of the air flow comprises a funnel-shaped part for engaging a wall of the dry dust chamber.

12. The vacuum cleaner according to claim 1 and including a filter for collecting dry dust in the airflow not collected by the dust chamber.

13. The vacuum cleaner according to claim 1 where the movable body includes a valve disposed for stopping airflow through the air outlet opening when the amount of dry dust in the dust chamber reaches a predetermined amount.

14. The vacuum cleaner according to claim 1 where the vibration of at least one of the movable body and the dust chamber is provided by the fan unit.

* * * * *